United States Patent [19]

Traxler

[11] Patent Number: 4,913,414

[45] Date of Patent: Apr. 3, 1990

[54] DAMPED SHEET REGISTRATION DRIVE

[75] Inventor: Michael W. Traxler, West Henrietta, N.Y.

[73] Assignee: Xerox Corporation, Stamford, Conn.

[21] Appl. No.: 232,836

[22] Filed: Aug. 16, 1988

[51] Int. Cl.[4] ..... B65H 31/36

[52] U.S. Cl. ..... 271/209; 271/220

[58] Field of Search ..... 271/207, 209, 220, 219, 271/161, 188, 121, 245, 275, 314

[56] References Cited

U.S. PATENT DOCUMENTS

| | | | |
|---|---|---|---|
| 3,087,725 | 4/1963 | Duncan | 271/219 X |
| 3,918,700 | 11/1975 | Donner | 271/220 X |
| 3,998,451 | 12/1976 | McInerny | 271/220 X |
| 4,084,809 | 4/1978 | Looney | 271/220 |
| 4,087,087 | 5/1978 | Looney | 271/173 |
| 4,676,498 | 6/1987 | Kanemitsu | 271/251 |

OTHER PUBLICATIONS

IBM Technical Disclosure Bulletin, vol. 24, No. 7B, pp. 3766, 3767, "Deskewing Document Feeder", N. K. Arter et al., Dec. 1981.

*Primary Examiner*—Richard A. Schacher

*Attorney, Agent, or Firm*—H. Fleischer; J. E. Beck; R. Zibelli

[57] ABSTRACT

A scuffer wheel drives a copy sheet into a registration corner on a tray of a printing machine. The vibration and hop of the scuffer wheel is damped by having the periphery of the scuffer wheel engage a leaf spring mounted over a slot in a thin plate mounted on the tray. This prevents sheet migration and misalignment of the sheets of the stack with respect to one another.

10 Claims, 4 Drawing Sheets

DAMPED SHEET REGISTRATION DRIVE

This invention relates generally to an apparatus for advancing a sheet, and more particularly concerns a drive for moving sheets into engagement with a registration guide used in a finishing station of an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. The copy sheets are then sorted and collected into sets of copy sheets at the finishing station. The copy sheets of each set are then secured to one another and stacked for presentation to the machine operator.

In order to secure the sheets of each set to one another, the copy sheets of the set have to be aligned with one another. This may be achieved by moving the leading edge of each sheet against a registration edge or into a registration corner. A registration drive advances successive copy sheets into engagement with the registration edge or corner of a compiler tray. Hereinbefore, the registration drive included a scuffer roller. Generally, the suffer roller engaged the upper surface of the copy sheet and frictionally drove the leading edge of the sheet into the registration corner. The scuffer roller is typically made from an elastomeric material and rotated at a prescribed angular velocity. The roller is oriented at a selected angle with respect to the centerline of the path of travel of the copy sheet. In this type of a drive system, the roller vibrated. In addition, as the roller rotated on a fixed surface, it would frequently stick and then slip. The sticking and slipping of the roller causes roller hop. Roller hop and vibration produces sheet migration resulting in the copy sheets of the set being mis-aligned from one another.

Various types of registration drives for aligning of sheets have been devised. The following disclosures appear to be relevant:

U.S. Pat. No. 4,087,087, Patentee: Looney, Issued: May 2, 1978.

Xerox Disclosure Journal. Volume 7, Number 6. Author: Taylor et al. Published: November/December 1982.

The relevant portions of the foregoing disclosures may be summarized as follows:

U.S. Pat. No. 4,087,087 describes a sheet stacking apparatus in which a guide bale directs an incoming sheet beneath a wheel. The wheel is driven at a speed slightly faster than the incoming sheet by a drive belt, which, in turn is driven by a drive wheel. The drive wheel provides a friction surface to control the delivery of sheets into the tray for registration against a wall of the tray.

The Xerox Disclosure Journal article discloses a scuffer wheel mounted in a slot of a ski. A portion of the wheel extends through the slot into engagement with a plate. The sheet is interposed between the ski and plate. The scuffer wheel advances the sheet across the plate until the lead edge of the sheet contacts a stop.

In accordance with one aspect of the present invention, there is provided an apparatus in which a stack of sheets is aligned on a tray. Means are provided for advancing successive sheets on the tray to form a stack of sheets thereon. Means damp the advancing means to prevent migration of the sheets on the tray and misalignment of the sheets of the stack with respect to one another.

Pursuant to another aspect of the features of the present invention, there is provided an apparatus for advancing a sheet. The apparatus includes a member adapted to support the sheet thereon. The member has a generally planar region and a raised region having a groove therein. A roller is adapted to advance the sheet on the member. The roller is adapted to have at least portion thereof extending into the groove in the raised region of the member. Means, engaging at least a portion of the peripheral surface of the roller at a contact region in the groove of the raised portion of the member, apply a resilient force on the roller at the contact region.

Still another aspect of the features of the present invention is a printing system, including means for reproducing copies of original documents on copy sheets. Means, positioned to receive the copy sheets from the reproducing means, are provided for sorting the copy sheets into sets of copy sheets. The sorting means comprises a tray adapted to support the copy sheets thereon. Means advance successive copy sheets on the tray to form a set of copy sheets thereon. Means are provided for damping the advancing means to prevent migration of the copy sheets on the tray and misalignment of the copy sheets of the stack with respect to one another.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
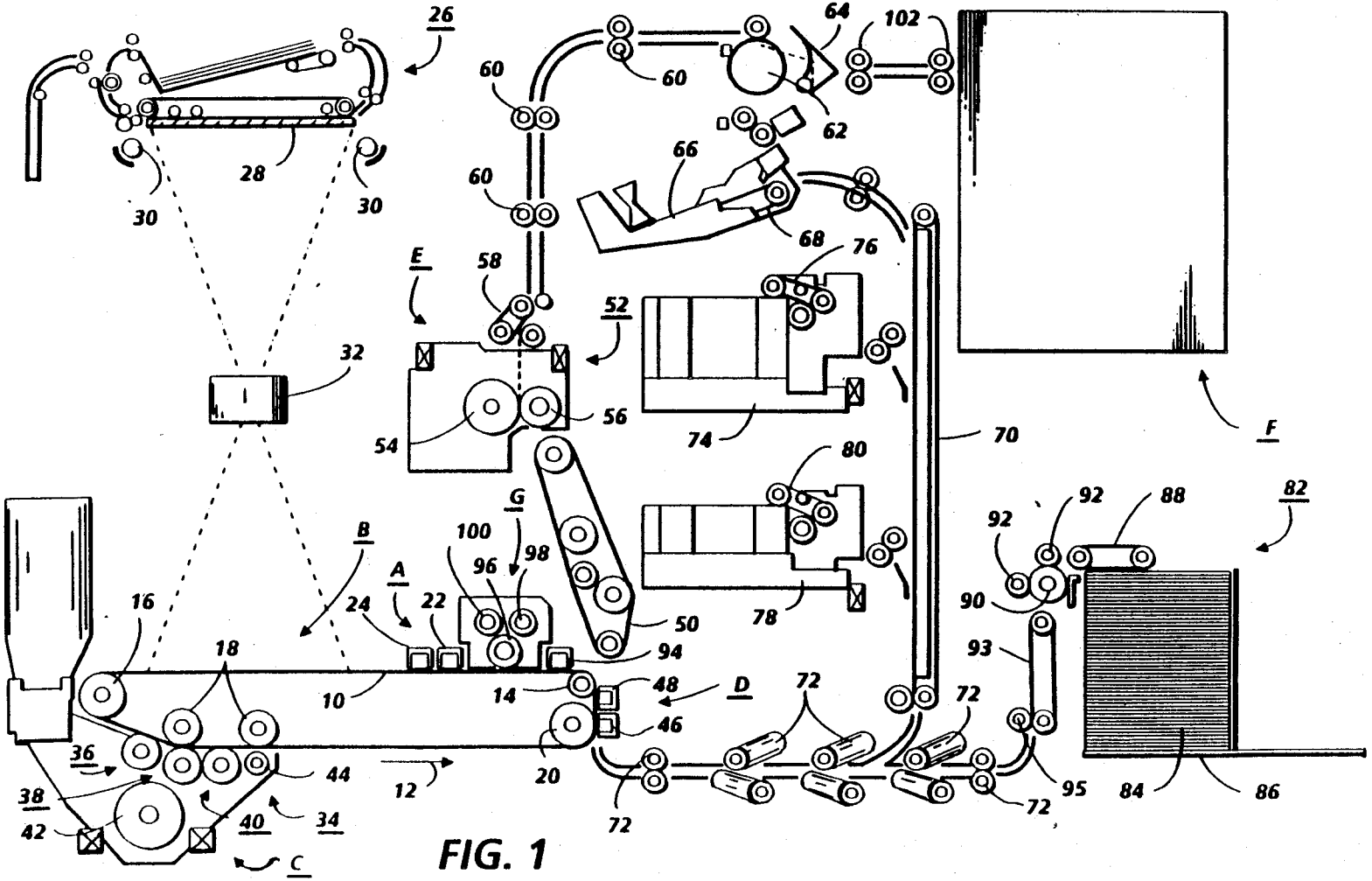
FIG. 1 is a schematic elevational view depicting an illustrative electrophotographic printing machine incorporating the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the scuffer wheel and damping system of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a grounding layer, which, in turn, is coated on a anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler roller 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or of this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. Conveyor 50 advances the copy sheet to fusing station E.

Fusing station E includes a fuser assembly, indicated generally by the reference numeral 52 which permanently affixes the transferred toner powder image to the copy sheet. Preferably, fuse assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heeated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding rollers 60 then advance the sheet to duplex turn roll 62. Duplex solenoid gate 64 guides the sheet to the finishing station F or to duplex tray 66. The details of finishing station F will be described hereinafter with reference to FIG. 2. Duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controllerr has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaning brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
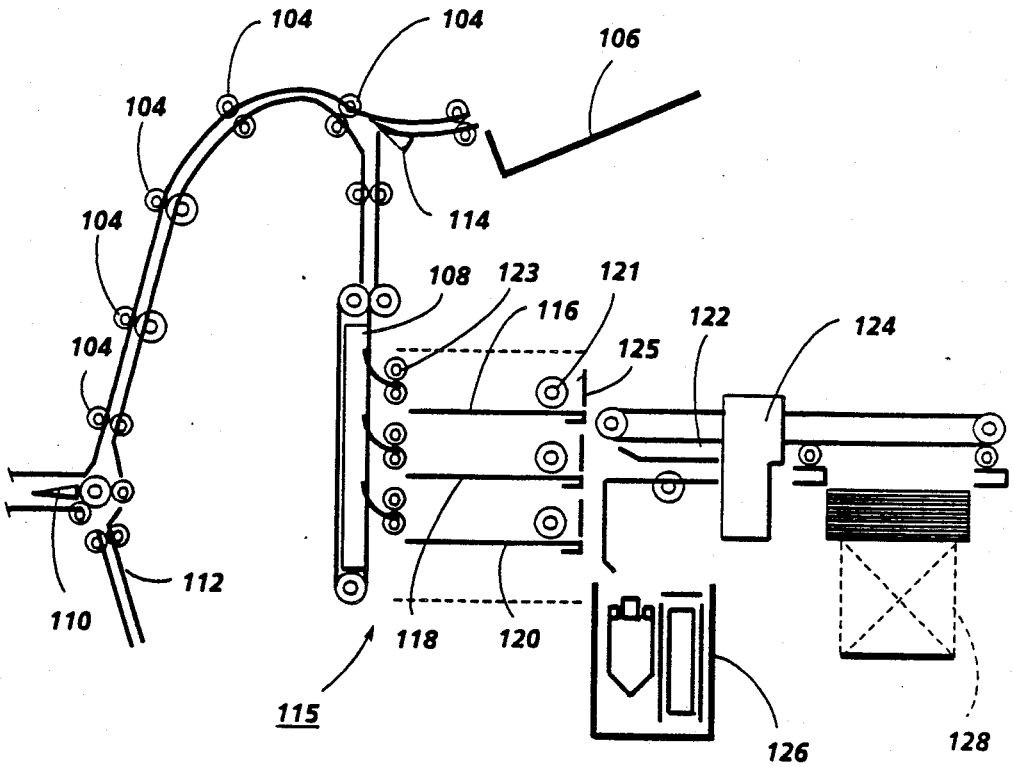
FIG. 2 is a schematic elevational view showing the finishing station of the FIG. 1 printing machine.

Referring now to FIG. 2, the general operation of finishing station F will now be described. Finishing station F receives fused copies from rolls 102 (FIG. 1) and delivers them to solenoid actuated gate 110. Gate 110 diverts the copy sheet to either registration rolls 104 or inverter 112. A tri-roll nip is used to drive sheets into and out of the inverter. Inverter 112 has a compression spring which assists in reversing the direction of the sheets and assists in driving them out of the inverter. Inverter 112 is driven by a reversible AC motor. Two cross roll registration nips are used to register the sheets. The cross roll registration nips are driven by the sheet path drive motor. Rolls 104 advance the copy sheets to gate 114. Gate 114 diverts the sheets to either the top tray 106 or to vertical transport 108. Vertical transport 108 is a vacuum transport which transports sheets to a sorting apparatus, indicated generally by the reference numeral 115. Sorting apparatus 115 has three trays 116, 118 or 120. The copy sheets are advanced to any one of the three trays 116, 118 or 120. Trays 116, 118, and 120 are used to sort and register the copy sheets into sets of copy sheets. The trays are driven up or down by a bidirectional AC drive motor adapted to position one of the trays at a discharge region where sets of copy sheets are removed therefrom. In the receiving position, successive copy sheets are advanced onto the tray. Inasmuch as all of the sorter trays are identical, only sorter tray 116 and the damped scuffer wheel 121 associated therewith will be described in detail. Rolls 123 advance successive copy sheets onto tray 116. Scuffer wheel 121 advances each copy sheet across tray 116 until the leading edge therof engages registration edge 125. Successive sheets are advanced onto tray 116 by rollers 123. Scuffer wheel 121 advances each copy sheet into engagement with registration edge 125 to form a stack or set of aligned copy sheets. Further details of scuffer wheel 121 and the damping system associated therewith will be described hereinafter with reference to FIGS. 3 and 4. After a tray is positioned at the discharge region with a complete set of copy sheets, a set transport 122, having a pair of set clamps mounted on two air cylinders and driven by four air valve solenoids, removes the set of copy sheets from the tray. Two of the air valves are used for positioning the set transport and two are used for the retract function. The set transport is used to transport sets from sorting apparatus 115 to sheet stapling apparatus 124, binder 126 and sheet stacker 128. The stapled, bound, or unfinished sets are delivered to stacker 128 where they are stacked for delivery to the operator.

Figure 3:
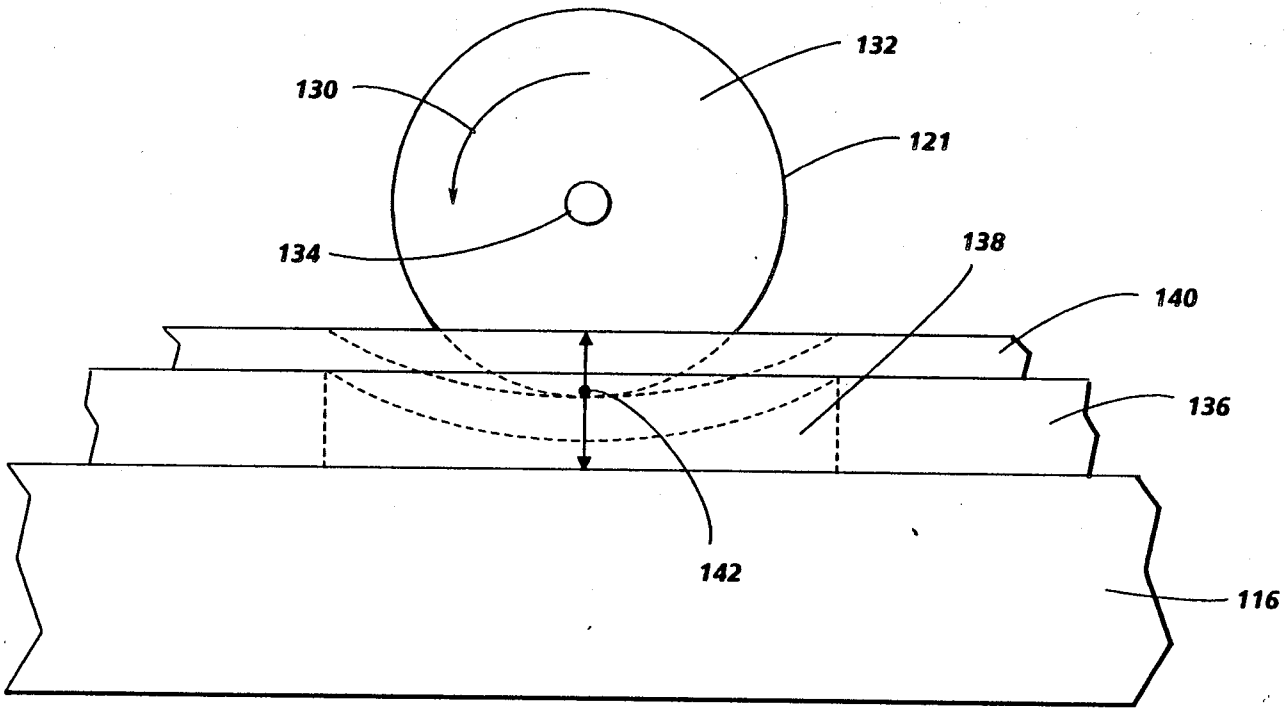
FIG. 3 is a schematic elevational view illustrating the scuffer wheel and damping system associated therewith used in the FIG. 2 finishing station.

Turning now to FIG. 3, scuffer wheel 121 rotates in the direction of arrow 130 to drive successive copy sheets into engagement with registration edge 125 (FIG. 2). Preferably, scuffer wheel 121 is made from a thick elastomeric sleeve 132 mounted on a substantially rigid shaft 134. A motor (not shown) is coupled to shaft 134 to rotate scuffer wheel 121 in the direction of arrow 130. Scuffer wheel 121 is mounted on brackets (not shown) which, in turn, are mounted pivotably on tray 116. In this way scuffer wheel 121 translates in a substantially vertical direction as the brackets pivot so as to remain in contact with the uppermost sheet being advanced onto tray 116. A plate and shim 136 is mounted on tray 116. Shim 136 has an aperture or rectangular cut-out 138 therein. Aperture 138 is larger than the diameter of scuffer wheel 121. Alternatively, a region of tray 116 may have a raised region with a groove therein. In either case aperture 138 is adapted to receive a portion of scuffer wheel 121 therein. A leaf spring 140 is mounted on shim 136. Spring 140 is interposed between scuffer wheel 121 and shim 136. Leaf spring 140 is mounted over aperture 138. Scuffer wheel 121 contacts leaf spring 140 at a constant point of contact 142. Contact point 142 remains unchanged as scuffer wheel 121 vibrates in a vertical direction. Spring 140 damps the vertical vibration of scuffer wheel 121. By way of example, shim 136 is made preferably from a plastic material with leaf spring 140 being made from a suitable sheet metal.

Figure 4:
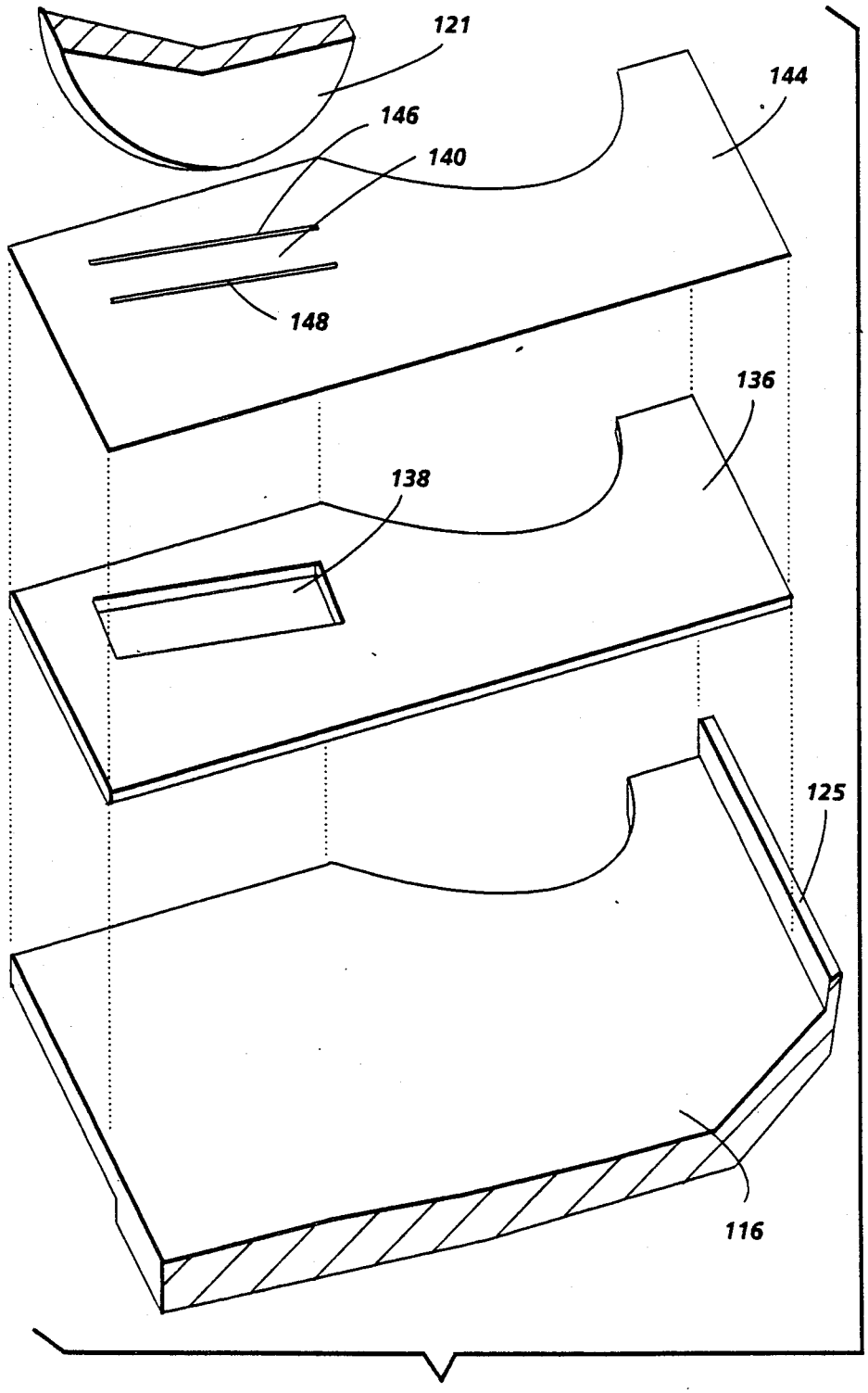
FIG. 4 is a schematic, exploded, fragmentary perspective view of the FIG. 3 scuffer wheel and damping system.

Referring now to FIG. 4, there is shown an exploded, fragmentary view of the scuffer wheel damping system. As shown thereat, leaf spring 140 is formed from a plate 144 having a pair of spaced slots 146 and 148 therein. The region between slots 146 and 148 defines leaf spring 140. Shim or plate 136 has a rectangular opening or aperture 138 therein. Plate 136 and plate 144 are substantially the same size and configuration. The region between slots 146 and 148 of plate 144 defining spring 140 is positioned over aperture 138. Scuffer wheel 121 is positioned in engagement with leaf spring 140. Plate 136 is mounted on the generally planar surface of tray 116. Plate 144 is, in turn, mounted on plate 136. A portion of scuffer wheel 121 is located in engagement with spring 140. Leaf spring 140 dampens the vertical vibration and hop of scuffer wheel 121. As scuffer wheel 121 moves in a vertical direction, leaf spring 140 deflects into aperture 138 without contacting the upper surface of tray 116.

One skilled in the art will appreciate that although the scuffer wheel and damping system associated therewith have been described in connection with a sorter used in a finishing station, the same type of a damping system may be employed for a scuffer wheel used in a document handling unit or any other situation requiring an elastomeric roll rotating on a fixed, rigid surface.

In recapitulation, the scuffer wheel of the present invention is mounted on a tray with a damping system associated therewith to prevent sheet migration of the aligned set of copy sheets. At least a portion of the scuffer wheel contacts a leaf spring mounted on a shim over an aperture therein. As the scuffer wheel vibrates, the leaf spring deflects into the aperture in the shim and dampens the vibration. The contact region between the leaf spring and scuffer wheel remains contant. A system of this type minimizes scuffer wheel hop and vibration preventing migration of the sheets so as to maintain the set of copy sheets in alignment.

It is, therefore, evident that there has been provided, in accordance with the present invention, a scuffer wheel and damping system that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus in which a stack of sheets is aligned against a registration member on a tray, including:

a roller adapted to advance successive sheets across the tray against the registration member to form a stack of sheets thereon;

a plate having an aperture therein, said plate being mounted on said tray; and a leaf spring mounted on said plate and extending over at least a portion of the aperture therein, said leaf spring contacting said roller in a contact region and being adapted to at least partially deflect into the aperture in said plate in response to movement of said roller with a sheet being interposed between said roller and said leaf spring when said roller advances the sheet.

2. An apparatus according to claim 1, wherein said roller is made preferably from an elastomeric material.

3. An apparatus according to claim 2, wherein said said plate is made preferably from a plastic material.

4. An apparatus according to claim 2, wherein said said leaf spring is made preferably from a metal material.

5. A printing system, including:

means for reproducing copies of original documents on copy sheets; and means, positioned to receive the copy sheets from said reproducing means, for sorting the copy sheets into a set of copy sheets, said sorting means comprising a tray adapted to support the copy sheets thereon, a roller adapted to advance successive copy sheets on the tray to form a set of copy sheets thereon, said tray includes a generally planar region and a raised region having a groove therein, said roller being adapted to have at least portion thereof extending into the groove in the raised portion of said tray and means, engaging at least a portion of the peripheral surface of said roller at a contact region in the groove of the raised region of said tray, for applying a resilient force on said roller at the contact region with a sheet being interposed between said roller and said applying means when said roller advances the sheet.

6. A printing system according to claim 5, wherein the raised portion of said tray includes a plate having an aperture therein defining the groove thereof.

7. A printing system according to claim 6, wherein said roller is made preferably from a resilient material.

8. A printing system according to claim 7, wherein said applying means includes at least a leaf spring mounted on said plate and extending over at least a portion of the aperture therein, said leaf spring contacting said roller in the contact region and being adapted to at least partially deflect into the aperture in said plate in response to movement of said roller.

9. A printing system according to claim 8, wherein said roller is made preferably from an elastomeric material.

10. A printing system according to claim 9, wherein said plate is made preferably from a plastic material.

* * * * *